United States Patent [19]

Le Parquier et al.

[11] Patent Number: 4,792,697

[45] Date of Patent: Dec. 20, 1988

[54] SUPPORT DEVICE CONTROLLED IN DEPENDENCE ON THE MOVEMENT OF A HELMET WITH RESPECT TO A SURROUNDING STRUCTURE

[75] Inventors: Guy Le Parquier; Jean L. Pastre, both of Paris, France

[73] Assignee: Thomson-CSF, Paris, France

[21] Appl. No.: 95,473

[22] Filed: Sep. 11, 1987

[30] Foreign Application Priority Data

Sep. 12, 1986 [FR] France ..... 86 12816

[51] Int. Cl.[4] ..... G01V 9/04

[52] U.S. Cl. ..... 250/561; 356/152

[58] Field of Search ..... 250/560, 561; 356/152, 356/141; 901/47; 358/104, 250

[56] References Cited

U.S. PATENT DOCUMENTS

| | | | |
|---|---|---|---|
| 4,028,725 | 6/1977 | Lewis | 358/103 |
| 4,475,814 | 10/1984 | Marche | 356/152 |
| 4,684,249 | 8/1987 | Ellis | 356/152 |
| 4,722,601 | 2/1988 | McFarlane | 356/152 |

FOREIGN PATENT DOCUMENTS 0162713 11/1985 European Pat. Off. .

OTHER PUBLICATIONS

Proceedings of SID, vol. 19, No. 4, 1978, pp. 181–185. Los Angeles, U.S.; L. Russo: "Helmet mounted visually coupled systems" FIGS. 2, 3; page 183, Col. 1, 1. 10–19.

*Primary Examiner*—David C. Nelms
*Assistant Examiner*—Jessica Ruoff
*Attorney, Agent, or Firm*—Cushman, Darby & Cushman

[57] ABSTRACT

The optical and electronic equipment normally carried by an aircraft pilot's helmet is carried by a support element which is placed at a distance from the helmet and accordingly relieves the load on the pilot's head. The support element is maintained in a predetermined position location with respect to the helmet by means of a detection assembly, a computer for determining errors in positioning, a control circuit which generates signals corresponding to these errors, and a set of jacks controlled by the error signals for modifying the position of the support element with respect to the aircraft structure and cancelling the positioning errors.

7 Claims, 10 Drawing Sheets

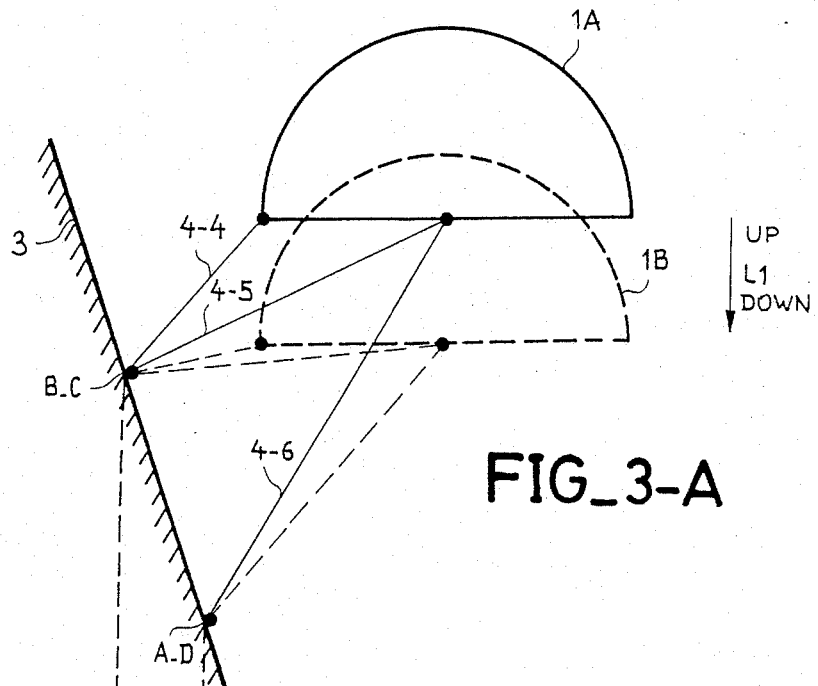
FIG_3-A
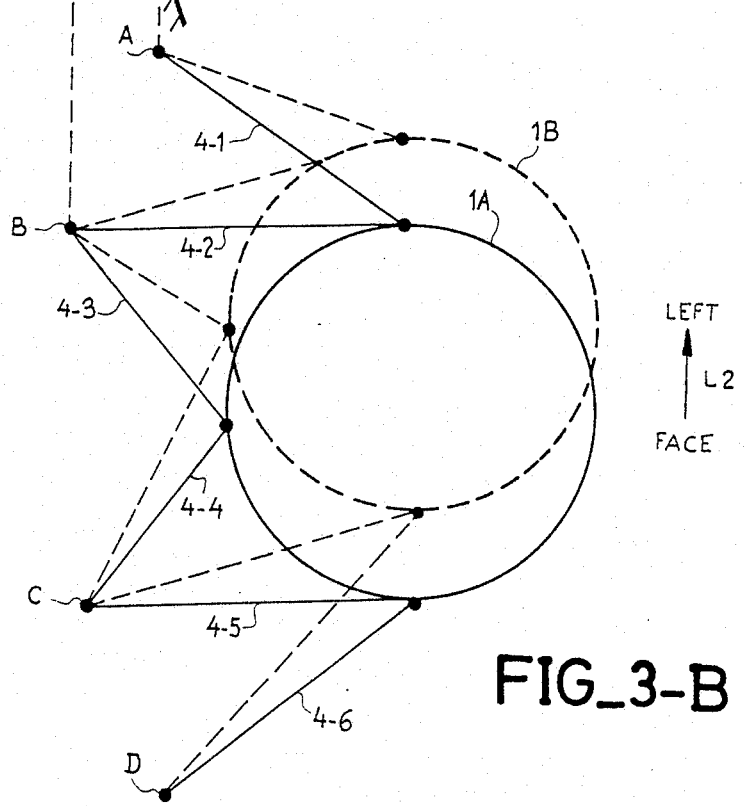
FIG_3-B

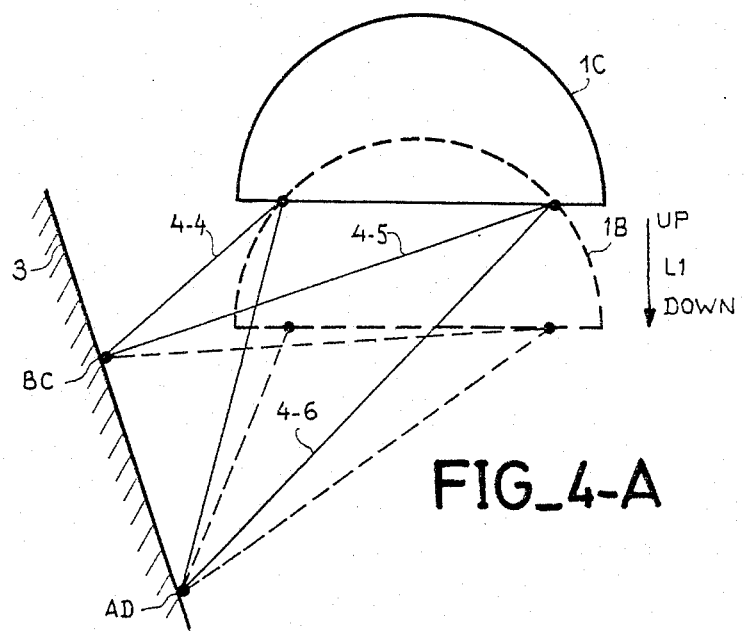
FIG_4-A
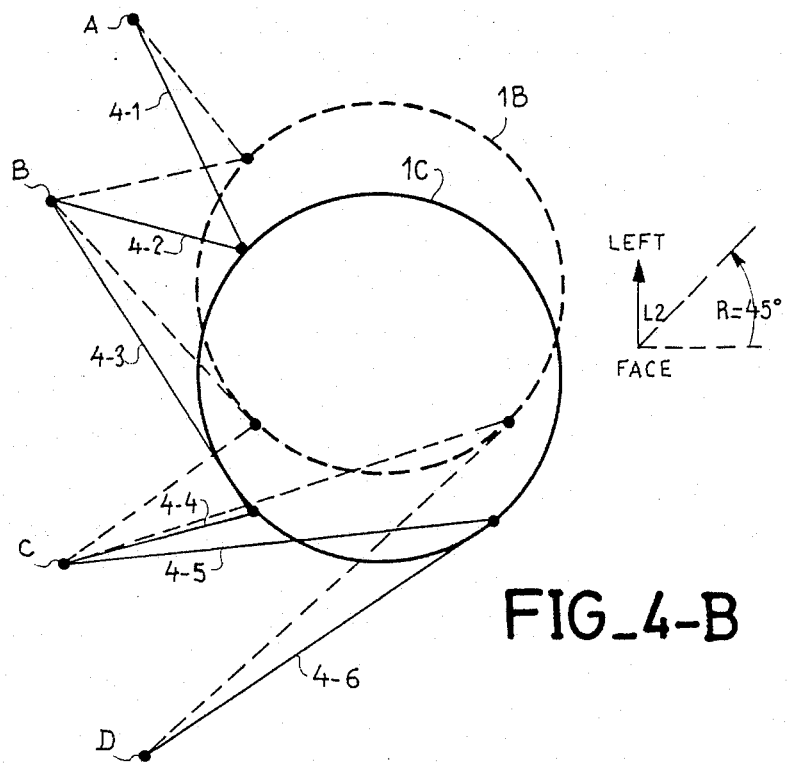
FIG_4-B

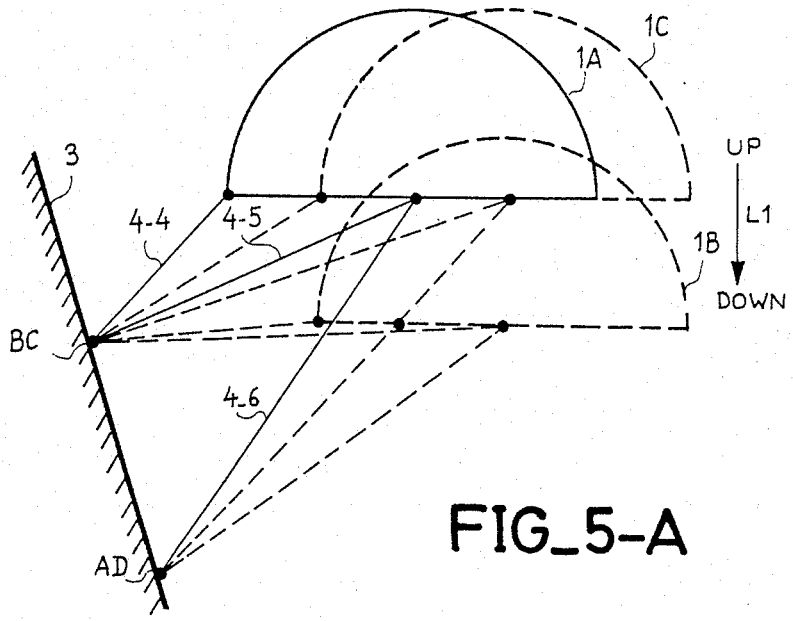
FIG_5-A
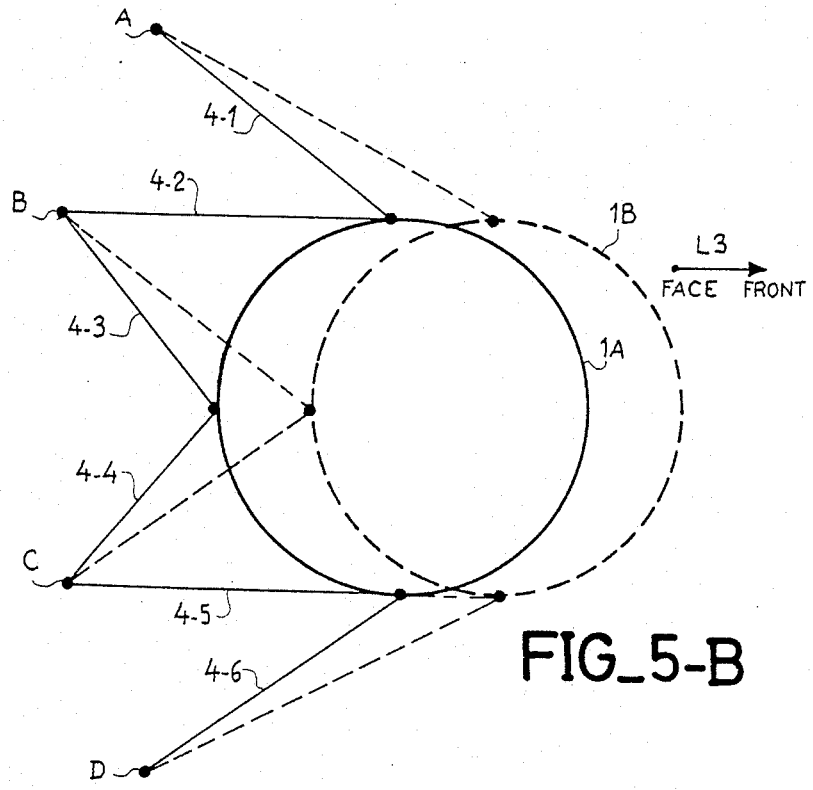
FIG_5-B

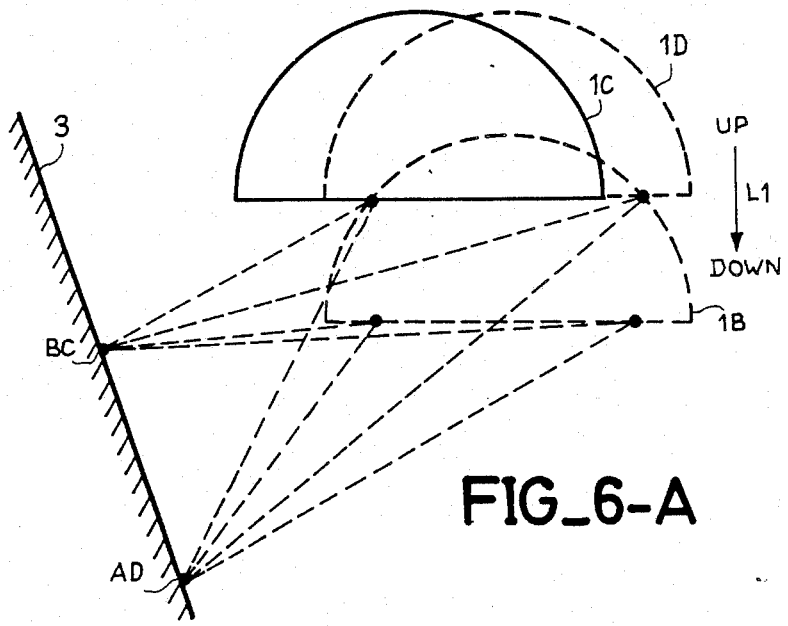
FIG_6-A
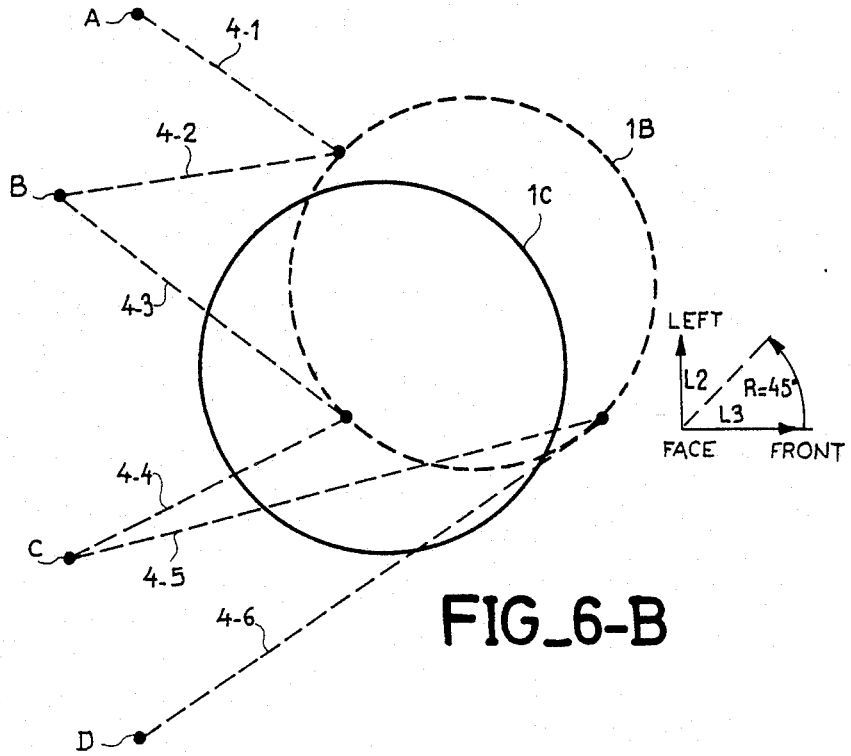
FIG_6-B

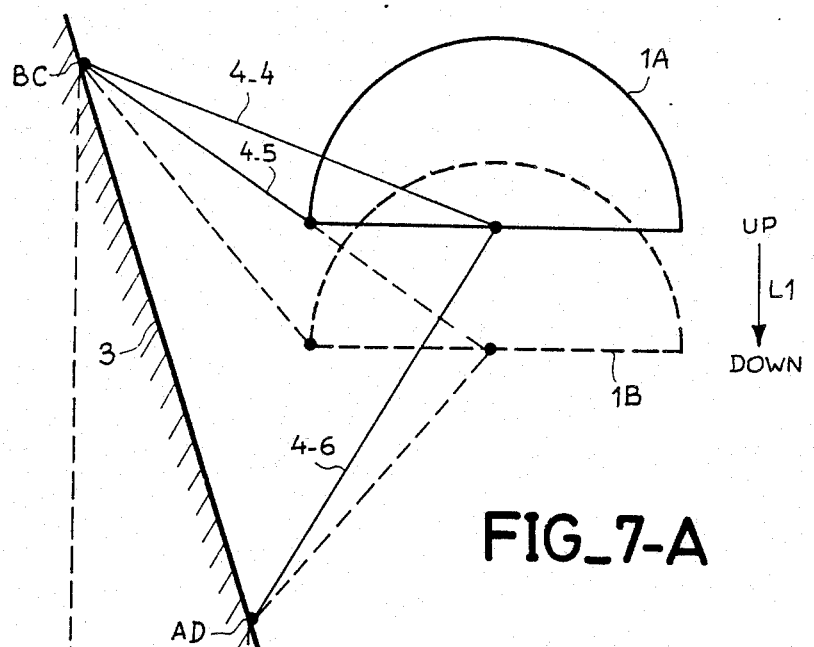
FIG_7-A
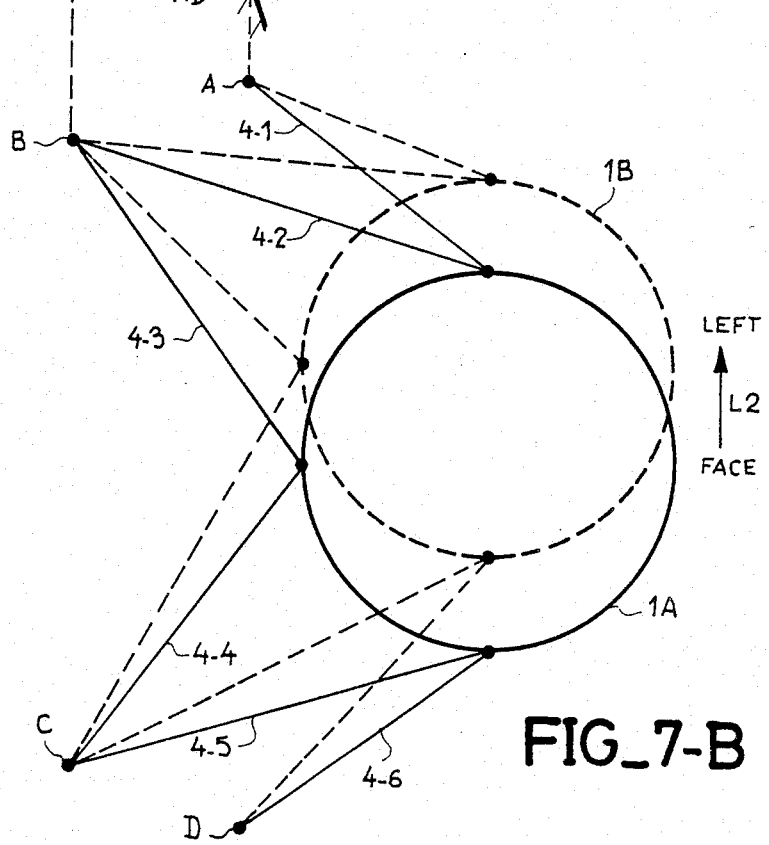
FIG_7-B

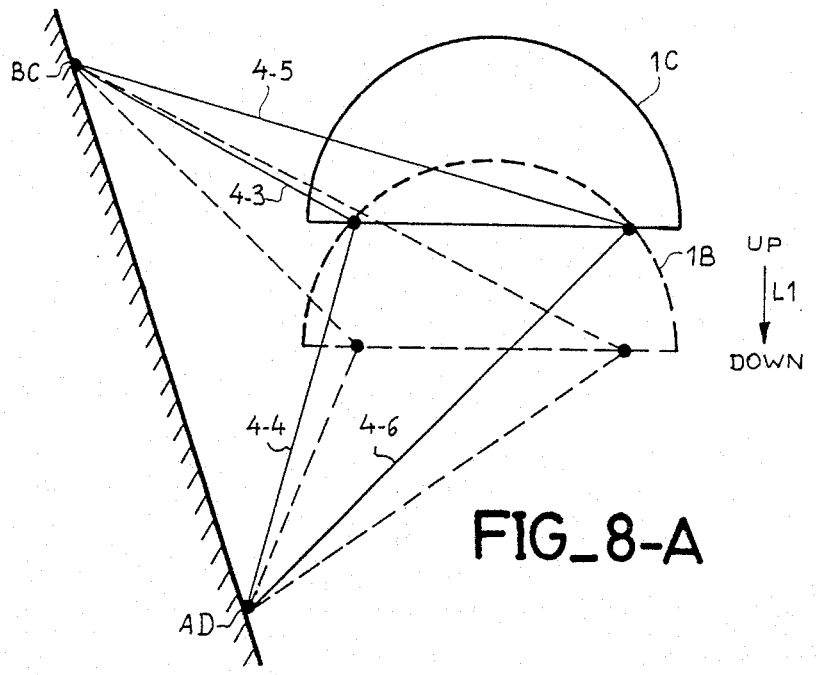
FIG_8-A
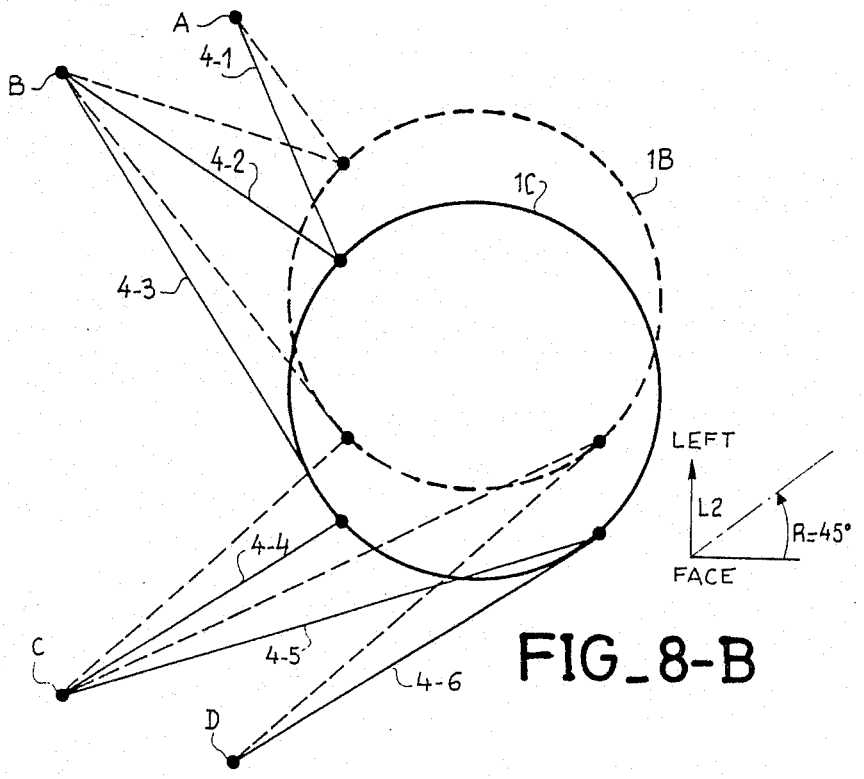
FIG_8-B

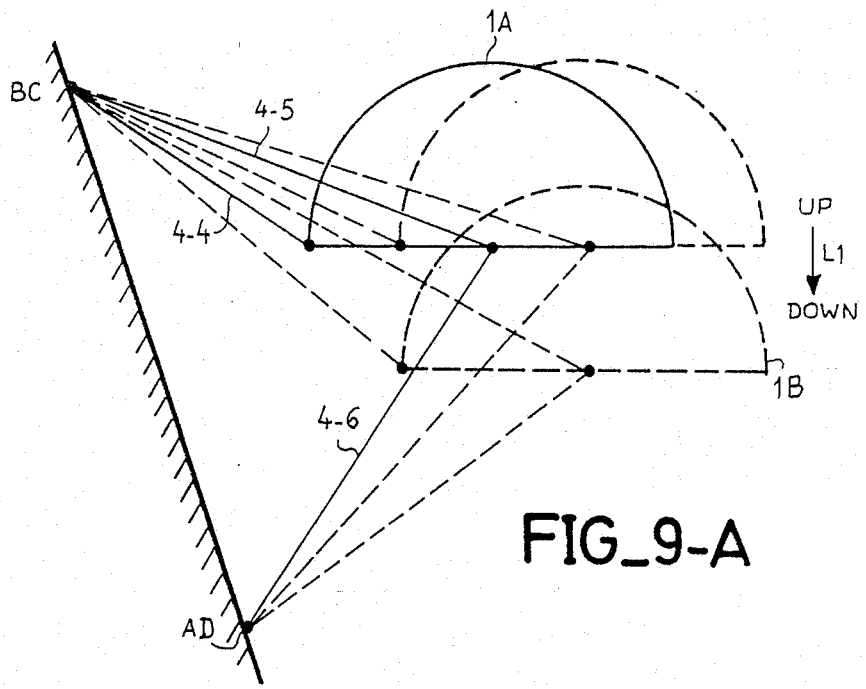
FIG_9-A
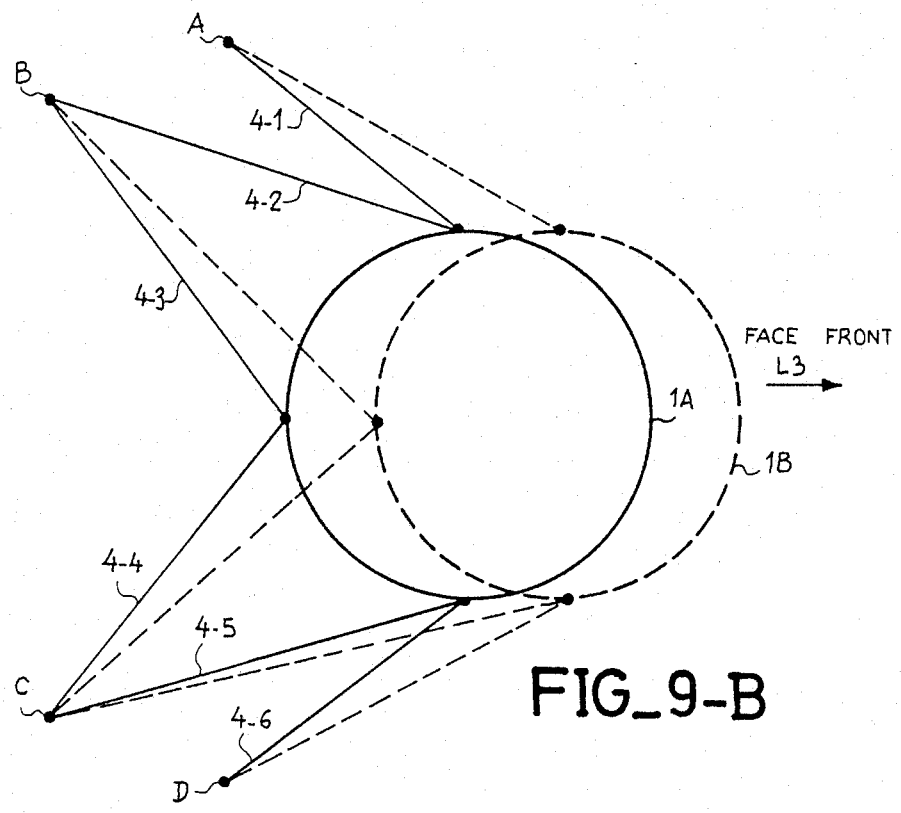
FIG_9-B

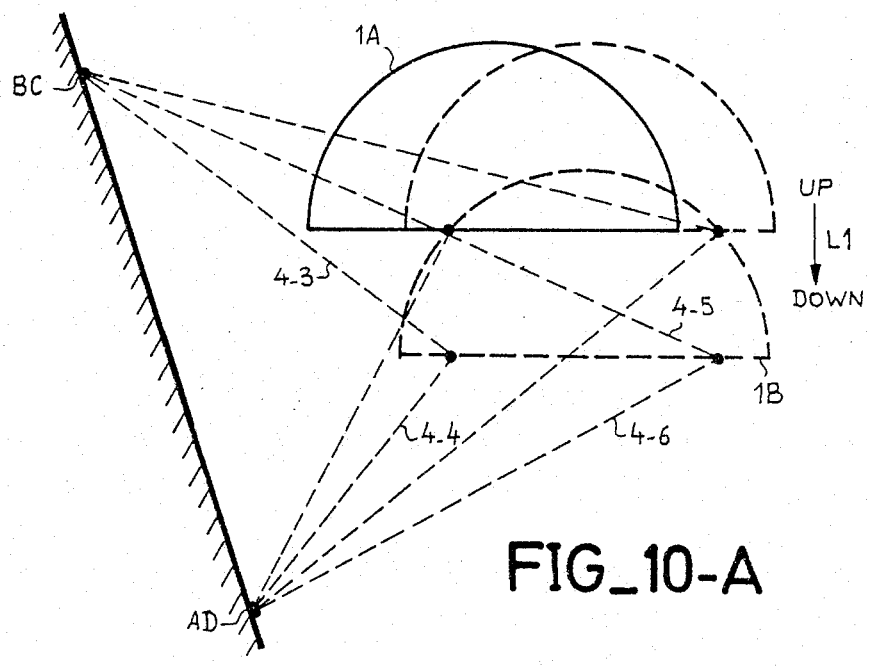
FIG_10-A
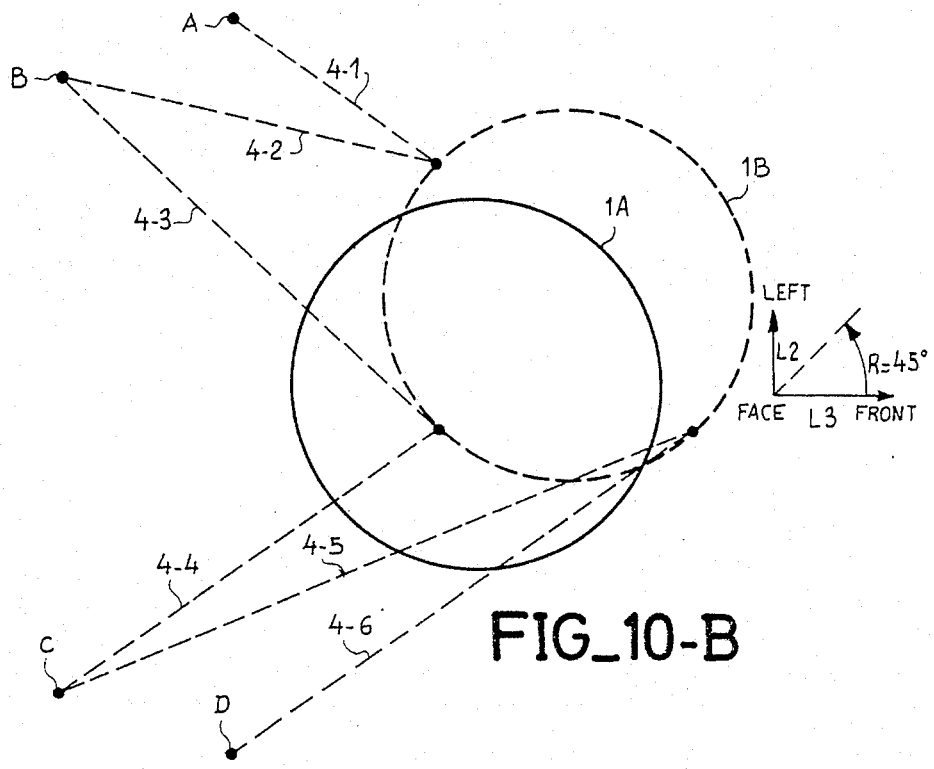
FIG_10-B

SUPPORT DEVICE CONTROLLED IN DEPENDENCE ON THE MOVEMENT OF A HELMET WITH RESPECT TO A SURROUNDING STRUCTURE

BACKGROUND OF THE INVENTION

1. Field of the Invention

The present invention relates to a support device controlled in dependence on the movement of a helmet with respect to a surrounding structure, the helmet being worn on an operator's head. More specifically, the invention permits control of the device in dependence on movements of the head which are exerted within a well-defined volume, the device being thus used for supporting equipment normally mounted on the helmet and for relieving the operator of the corresponding load.

2. Description of the Prior Art

The use of the invention is more particularly contemplated in the field of avionics for solving the problem of video image display in a large field of view and with high resolution. In fact, the pilot on board a fighter aircraft is installed within a cockpit of small size and in most cases in a recumbent position, which hardly facilitates reading of instruments on the aircraft instrument panel. For example, a cathode-ray-tube (CRT) screen indicator providing an elaborate video display is therefore always perceived at a small angle, with the result that its effectiveness is impaired. The collimated display device mounted on a helmet restores a certain degree of visual comfort for the pilot but remains limited to small fields or, in the case of larger fields, to a medium resolution corresponding, for example, to an image of 250 points per line and of 250 lines. The installation on a helmet of a large-field display having high resolution (namely a resolution which is higher than 1000 points per line) results in prohibitive weight which is not compatible with accelerations of up to approximately 8 g for which the aircraft is designed.

The object of the invention is to overcome these disadvantages and limitations by making use of a support device which is mechanically decoupled from the pilot's helmet, which is placed at a short distance from said helmet in a predetermined position and which is controlled in dependence on the movements of the pilot's head and therefore of the pilot's helmet. This support device is thus capable of performing the function of the helmet and replaces this latter for the purpose of carrying the necessary electro-optical equipment. In particular, it will be possible to install a large-field high-resolution display system on this support device. The pilot is freed from the weight of these equipment elements and is thus permitted to move his head freely.

SUMMARY OF THE INVENTION

In accordance with the invention, there is provided a support device controlled in dependence on the movements of a helmet with respect to a surrounding structure, said device being constituted by a support element placed at a distance from the helmet and mechanically decoupled from said helmet, and position-control means for maintaining a predetermined reference position-location of said support element with respect to said helmet in order to utilize the device for supporting equipment normally mounted on the helmet, said position-control mean being constituted by:

- means for detecting the position-location of the support element with respect to the helmet;
- a set of jacks for mechanically coupling the support element to the structure;
- computing means for controlling the jacks and having the function of computing from the signals detected by said detection means the errors in positioning of the support element with respect to the helmet and of generating corresponding control signals for actuating the jacks and cancelling said errors.

BRIEF DESCRIPTION OF THE DRAWINGS

FIGS. 3 to 6 are examples of combination of movements of the jacks for producing various possible displacements of the supoort device and show the corresponding displacements.

FIGS. 7 to 10 illustrate the same movements but with points of articulation of the jacks at higher locations on the structure.

DESCRIPTION OF THE PREFERRED EMBODIMENTS

Figure 1:
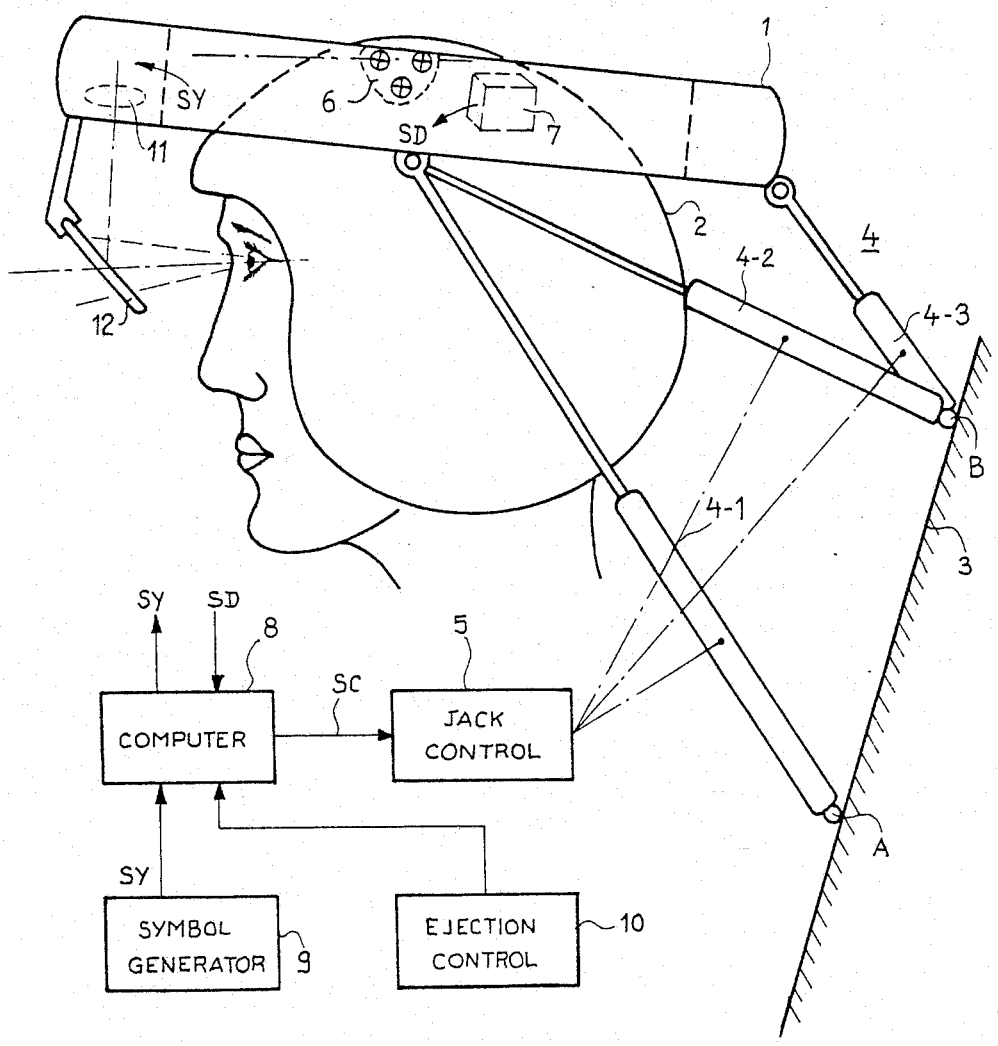
FIG. 1 is a general diagram of a support device in accordance with the invention as applied to the case of a helmet visor.

It is apparent from FIG. 1 that the device comprises a principal element 1 placed at a distance from a movable element 2 represented by a conventional helmet placed on the pilot's head, and means for controlling the position of the element 1 in a given reference position with respect to the helmet.

The helmet 2 is movable with respect to a surrounding structure 3 such as an aircraft structure, for example, as partially represented by hatching lines.

The principal element 1 is mechanically decoupled from the helmet 2 and is employed instead of this latter for supporting the optoelectronic equipment.

Said principal element 1 is maintained spatially in position with respect to the helmet 2 by means of mechanical coupling members which connect said element to the structure 3, said members being connected to a control device for maintaining the reference position between the elements 1 and 2.

The mechanical coupling members 4 are intended to constitute a structure which has the function of maintaining the support element 1 in position about its six degrees of freedom with tracking of the helmet 2 and which achieves a high degree of accuracy (of the order of one milliradian).

This controlled structure is also expected to satisfy a certain number of additional and specific requirements in the field of application of airborne equipment under consideration. These complementary requirements are essentially of three kinds:

- small overall size by reason of the limited available space;
- very high resistance to accelerations: this resistance must be of the same order of magnitude as that of the aircraft structure or in other words higher than 10 g;

provision for the necessary clearance both in order to enable the pilot to take his place within the aircraft and subsequently in order to initiate ejection of the pilot's seat should the need arise.

In order to meet these requirements, mechanical coupling is ensured by means of jacks 4 which are six in number in order to exert the action in the six degrees of freedom. Three jacks are illustrated in the figure and designated by the references 4.1, 4.2 and 4.3.

The jacks chosen for this purpose are advantageously of the double-travel type, that is, of the type in which the travel is equal to twice the length less the length which is necessary for guiding.

The other circuits shown in the drawings include, for position control, a circuit 5 for controlling the jacks, means 6–7 for detecting the position-location of the support element 1 with respect to the helmet 2, and an associated computer 8.

Figure 2:
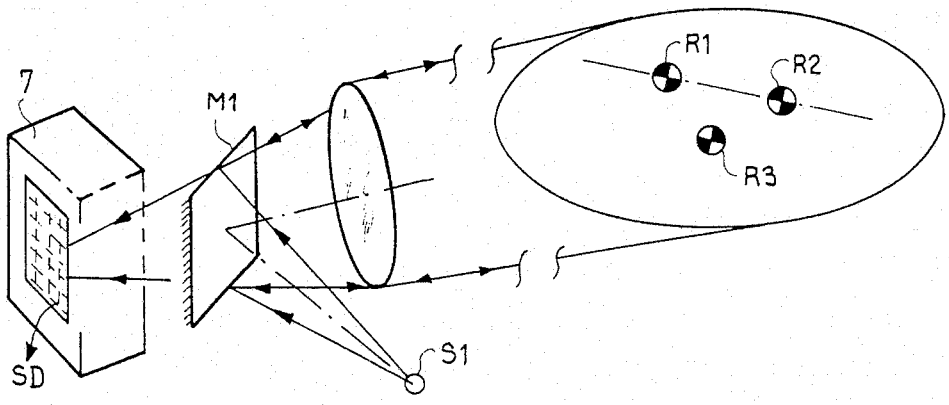
FIG. 2 is a detail diagram showing one example of detection of position-location of the support element with respect to the helmet.

The position detection means can be constructed in accordance with a number of alternative designs which fall into two main classes, namely electro-optical devices and magnetic devices. One electro-optical device of known design can be constructed with at least one group of electroluminescent diodes forming a triangle and associated with an array of elementary electro-optical sensors. An on-board computer processes the detected signals in order to measure a reference direction (or a number of reference directions) related to the pilot's helmet. A solution of this type is described in U.S. patent U.S. Pat. No. 4,193,689. Each elementary sensor is formed of a linear array of photosensitive elements or a so-called CCD strip which is coupled with a slit for determining a plane which passes through the emitting luminescent source. An auxiliary computation makes it possible to localize the different planes, then the triangle formed by the sources and, consecutively, the direction to be located. This technique is transposable to the case under consideration, subject to the modification indicated in FIG. 2 for reducing the weight of the helmet and removing active elements from this latter. The electroluminescent diodes are replaced by patterns known as reticles R1, R2, R3 carried by the helmet 2 and illuminated at a distance from a point source S1 carried by the support element 1. The radiation reflected from the reticles is received at least partially by the sensing device 7 which includes a CCD matrix array of elements disposed along axes X, Y. The semi-reflecting mirror M1 placed behind an optical system O1 ensures separation of the emitting and receiving channels and coaxial alignment. The reticles R1 to R3 can be arranged in accordance with the pattern indicated by way of example nnd can be constructed of retroreflecting material (adhesively bonded elements or paint). The signals SD detected by the CCD matrix array of the sensor on which is formed the image of illuminated reticles are a function of the position of the reticles with respect to the sensor. These signals are processed by the computer 8 which delivers the data relating to the position of the element 1 with respect to the helmet 2. Pre-established data relating to the reference position-location are included in the computer memory for obtaining these conditions of withdrawal of the element 1 with respect to the helmet 2. The computer 8 gives at each instant the errors in position of the support element 1 and converts these error data to control signals SC. These signals are transmitted to the control circuit 5 and this latter delivers the corresponding analog signals required for actuating the six jacks.

The proposed solution as applied to a helmet visor offers many advantages which are listed below:

the device does not add any weight or represent any additional inconvenience for the pilot;

it is capable of supporting the large optical systems required for producing large-field displays with high resolution and in color if necessary, as well as the associated electronic devices and integrated display screens;

the direction sighted by the pilot is automatically known with precision;

complementary equipment which is not customarily employed in helmets or head-mounted systems may be added, one example of such equipment being a laser protection system.

The means for locating the support element 1 with respect to the helmet 2 can consist of a plurality of assemblies 6–7, for example by doubling this equipment on each side of the plane of symmetry of the helmet. The helmet thus carries laterally on the right and on the left a group of three reticles designated on one side by the reference 6A and on the other side by the reference 6B. In substantially oppositely-facing relation, the support element 1 will comprise a first sensor 7A on one side and a second sensor 7B on the other side.

The support element 1 can be of toric shape as shown in FIG. 1 with the requisite electro-optical equipment located within the torus. An optical collimating system 11 and an externally located reflecting mirror 12 are shown by way of example. These elements can form part of a large-field high-resolution collimating system.

The fact that the displayed portion of the space changes with the rotational movement of the pilot's head permits representation of a total field of view which is three to six times larger than that of the display device.

By way of example, if the display device has a field of 50° and a resolution of 1000 points per line, the angular resolution is one milliradian in respect of a total field of 150° as required for navigation and reading of the fictitious panel instruments produced by the equipped support device 1. In the case of a display with a field angle of 15° and also 1000 points per line, there is obtained an angular resolution of 0.3 milliradian in a total field of 100° which is necessary for locating and identifying targets. It is readily apparent that, if the display device has even higher resolution, all these performances are improved even further.

A symbol generator 9 can be employed for producing a predetermined display and for supplying the collimator with corresponding signals SY via the computer 8.

FIGS. 3 to 6 represent different combinations of movements of the jacks in order to obtain a response to displacements of the support device as a function of displacements of the pilot's head or of the observer's head. Consideration has been given to a translational displacement L1 either in a vertically upward direction or in a vertically downward direction, to a translational displacement L2 in the horizontal direction starting from the initial reference position or so-called "front" position, said movement L2 being carried out either towards the left or towards the right. Consideration is also given to another translational displacement L3 in the forward direction starting from the "front" position. Finally, consideration is given to an angular displacement by rotation in azimuth through an angle of ±45°.

Each of these figures is made up of a first figure representing motion in the vertical plane and of a second figure representing motion in the horizontal plane.

Thus FIGS. 3A and 3B represent by way of example a movement resulting from the two translational displacements L1 and L2 respectively in the vertically downward direction and from the front position towards the left. The support element passes from the initial rest position 1A to the final position 1B.

FIGS. 4A and 4B represent these same movements of translation with an additional movement of rotation in azimuth through an angle of 45° and towards the left. The position 1C of the element represents this latter after it has completed this movement of rotation through 45°.

FIGS. 5A and 5B relate to a third example in which a translational displacement L1 takes place in the downward direction and a translational displacement L3 takes place from the front reference position in the forward direction.

FIG. 6 again shows the displacements L1 and L3 of FIG. 5 with an additional translational displacement L2 from the front position towards the left and an additional movement of rotation in azimuth through an angle of 45° and also towards the left.

FIGS. 7 to 10 correspond respectively to the same movements as in FIGS. 3 to 6 but with points of articulation at higher locations on the structure (points B and C of the jacks 4-2, 4-3, 4-4 and 4-5). In this case, the relative displacements are shorter.

The points of articulation of the jacks on the structure 3 are located on the fixed portion of the ejection seat while remaining rigidly fixed to the aircraft structure or else they are directly fixed on the aircraft structure behind the pilot's seat and laterally with respect to this latter. The points of articulation at the end corresponding to the support device 1 are chosen so as to ensure that there are at least three points of articulation at the vertices of a triangle and that they are not liable to hinder the pilot. In other words, they must not be located in front, which would in any case make the structure difficult and even impossible to realize in practice. The points of attachment of the jacks to the support element 1 define a plane whose position in space is controlled by jacks 4.

Figure 11:
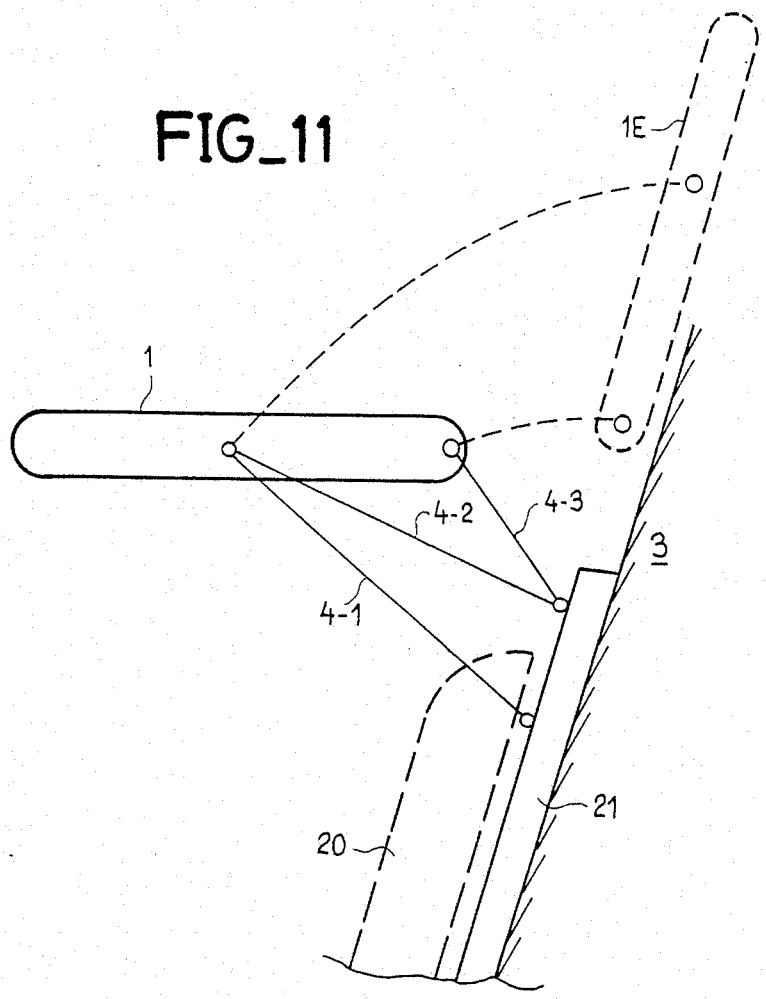
FIG. 11 is a detail diagram relating to withdrawal of the support device for permitting ejection of the pilot's seat.

FIG. 11 is a schematic illustration showing the withdrawal of the support element 1 in order to permit ejection of the seat. The ejection means comprise a control unit 10 (shown in FIG. 1) which, through the intermediary of the computer, will actuate the jacks in such a manner as to ensure that the support element 1 takes up the position of withdrawal 1E as shown. The portion 20 represents the seat-back of the ejection seat whilst the portion 21 represents the fixed upright member of the seat which is rigidly fixed to the aircraft structure 3.

What is claimed is:

1. A support device controlled in dependence on the movement of a helmet with respect to a surrounding structure, wherein said device is constituted by a support element placed at a distance from the helmet and mechanically decoupled from said helmet, and position-control means for maintaining a predetermined reference position-location of said support element with respect to said helmet in order to utilize the device for supporting equipment normally mounted on the helmet, said position-control means being constituted by:

means for detecting the position-location of the support element with respect to the helmet;

a set of jacks for mechanically coupling the support element to the structure;

computing means for controlling the jacks and having the function of comptting from the signals detected by said detection means the errors in positioning of the support element with respect to the helmet and of generating corresponding control signals for actuating the jacks and cancelling said errors.

2. A device according to claim 1, wherein said devce is provided with six jacks for producing action in six degrees of freedom.

3. A device according to claim 2, wherein the jacks are of the double-travel type.

4. A device according to claim 1, wherein the detection means are of the electro-optical type comprising at least one assembly composed of a group of reticles carried by the support element, an associated photoelectric sensor which is mounted on the helmet as well as a light source for illuminating said reticles.

5. A device according to claim 4, wherein the reticles are of retroreflecting material.

6. A device according to claim 1, wherein the support element has the shape of a torus.

7. A device according to claim 6 as employed for providing a helmet visor for an aircraft pilot, wherein the support element aforesaid supports optoelectronic means for obtaining a visor which provides a large field of view and high resolution.

* * * * *